US006744343B2

(12) United States Patent
Sugamura

(10) Patent No.: US 6,744,343 B2
(45) Date of Patent: Jun. 1, 2004

(54) FLYBACK TRANSFORMER MOUNTING STRUCTURE FOR VIDEO APPARATUS

(75) Inventor: Tomokazu Sugamura, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 10/382,428

(22) Filed: Mar. 6, 2003

(65) Prior Publication Data

US 2003/0169140 A1 Sep. 11, 2003

(30) Foreign Application Priority Data

Mar. 6, 2002 (JP) ..... 2002-001108 U

(51) Int. Cl.[7] ..... H01F 27/06

(52) U.S. Cl. ..... 336/67; 336/160; 336/212; 336/214; 336/215; 323/56

(58) Field of Search ..... 336/160, 212, 336/214, 215, 67; 323/56

(56) References Cited

U.S. PATENT DOCUMENTS 4,177,418 A * 12/1979 Brueckner et al. ..... 323/250

FOREIGN PATENT DOCUMENTS

JP 05-343236 12/1993
JP 06-124837 * 5/1994

OTHER PUBLICATIONS

Patent Abstracts of Japan, Publication No. 06–124837 dated May 6, 1994, 2 pages.

Patent Abstracts of Japan, Publication No. 05–343236 dated Dec. 24, 1993, 2 pages.

* cited by examiner

*Primary Examiner*—Elvin Enad
*Assistant Examiner*—Jennifer A. Poker
(74) *Attorney, Agent, or Firm*—Osha & May L.L.P.

(57) ABSTRACT

A flyback transformer is mounted on a main wiring board formed with a power circuit. A mounting bracket shaped like an L-character in plan view is integrally molded on a chassis. A mounting portion disposed at the top of the flyback transformer is fixed by screws to an upper end of the mounting bracket. A boss in a height middle portion of the mounting bracket is fitted into a cabinet.

5 Claims, 4 Drawing Sheets

FLYBACK TRANSFORMER MOUNTING STRUCTURE FOR VIDEO APPARATUS

The present disclosure relates to the subject matter contained in Japanese Utility Model Application No. 2002-001108 filed Mar. 6, 2002, which is incorporated herein by reference in its entirety.

BACKGROUND OF THE INVENTION

1. Field of the Invention

The present invention relates to a mounting structure of a flyback transformer equipped in a power circuit for a video apparatus such as a television receiver.

2. Description of the Related Art

FIG. 4 is an exploded perspective view showing the conventional structure of a flyback transformer mounting portion in a television receiver equipped with a flyback transformer (FBT) of this kind. In FIG. 4, 1 denotes a chassis, 2 denotes a main wiring board fixed to the chassis 1 by screws, 3 denotes a power circuit wiring board formed with a power circuit, 4 denotes the flyback transformer mounted on the power circuit wiring board 3, 5 denotes a holder to which the power circuit wiring board 3 is fixed by screws. The chassis 1 with the main wiring board 2 attached and the holder 5 for holding the power circuit wiring board 3 with the flyback transformer 4 mounted are accommodated in a cabinet. The heavy flyback transformer mounted on the power circuit wiring board 3 is supported by the holder 5 that is fixed to the cabinet by screws. In FIG. 4, 6 denotes a screw used for fixing the power circuit wiring board 3 to the holder 5.

In JP-A-5-343236 (prior example 1), there is disclosed a mounting structure in which a plate-like shield reinforcing fitting is coupled to a printed wiring board and raised from the printed wiring board, and a flyback transformer is fixed to the shield fitting by screws. Also, there is disclosed a mounting structure in which a boss at the top of the flyback transformer mounted on the printed wiring board is fixed by a screw via a holding device to a back cover, thereby preventing the flyback transformer from being moved back and forth, or right and left, when an impact load is applied. Also, in JP-A-6-124837 (prior example 2), there is disclosed a mounting structure in which a printed board with a flyback transformer mounted is fixed by screws to a receptacle as the holder, which is attached on a bottom plate of the cabinet, a boss at the top of the flyback transformer is loosely inserted into a through hole formed in an end plate of the cabinet, and a collar head screw is fitted into the boss to restrict a clearance width.

However, in the conventional flyback transformer mounting structure as shown in FIG. 4, since the holder 5 is provided separately from the chassis 1 and fixed to the cabinet by screws, the holder is required in excess and an operation process for attaching the holder to the cabinet is also needed in excess, which imposed restrictions on reducing the price.

On the contrary, in the mounting structure in which the flyback transformer is fixed by screws to the shield reinforcing fitting of prior example 1, the heavy flyback transformer is supported only by the soldered portion with the printed wiring board, and the shield reinforcing fitting soldered to the printed wiring board. Thus, it cannot be the that the mounting structure can fully withstand an impact when dropped. Also, in the mounting structure in which the boss at the top of the flyback transformer mounted on the printed wiring board of prior example 1 is fixed by screws via the holding device to the back cover, the flyback transformer is mounted on two members of the printed wiring board and the back cover. Thus, in case where the printed wiring board and the back cover are displaced by an impact when dropped, there is a risk that a large stress is applied on a portion of attaching the boss of the flyback transformer to the back cover, thereby breaking that portion.

In the prior example 2, the flyback transformer is just restricted moving more than a predetermined amount by an impact when dropped. Thus, it is difficult to say that the mounting structure is able to fully support the heavy flyback transformer against the impact when dropped. Also, the holder is required in excess, and the operation process for attaching the holder to the cabinet is required in excess, resulting in a problem that they impose restrictions on reducing the price.

SUMMARY OF THE INVENTION

This invention has been achieved in the light of the above-mentioned problems, and it is an object of the invention to provide a flyback transformer mounting structure for a video apparatus which can securely support a heavy flyback transformer with a high impact resistance against an impact when dropped, in which the flyback transformer is mounted on a main wiring board formed with a power circuit for connecting with the flyback transformer, and a holder for holding a power circuit wiring board is omitted to reduce the price.

The present invention provides a flyback transformer mounting structure for a video apparatus, comprising: a main wiring board; a power circuit formed on the main wiring board; a flyback transformer mounted on the main wiring board, the flyback transformer having a mounting portion; a chassis to which the main wiring board is attached; and a mounting bracket linked integrally with the chassis, wherein the mounting portion of the flyback transformer is fixed by a screw to the mounting bracket.

In this mounting structure, the main wiring board has the power circuit, whereby the flyback transformer mounted on the main wiring board can be connected to the power circuit. Therefore, the power circuit wiring board and the holder for holding it are unnecessary, the number of parts is reduced, and the operation process for fixing the power circuit wiring board to the holder and the operation process for fixing the holder to the cabinet are unnecessary, whereby the price is reduced. Also, the mounting portion of the flyback transformer is fixed by a screw to the mounting bracket linked integrally with the chassis, and the mounting bracket is preferably fixed by a screw to the cabinet, whereby the chassis and the mounting bracket are unmovably supported by the cabinet, and the heavy flyback transformer is held by the chassis and the mounting bracket linked integrally with the chassis. Hence, even if the chassis with the mounting bracket and the cabinet are displaced due to an impact when dropped, its influence is not applied on the mounting portion (including the connecting portion by solder) of the flyback transformer to the chassis and the cabinet, so that the excellent impact resistance is exhibited.

In this invention, it is preferable that the chassis and the mounting bracket are integrally molded of synthetic resin, and the mounting bracket is shaped like an L-character in plan view, and raised at the corner portion of the chassis. In this case, the chassis and the mounting bracket are integrally molded of synthetic resin, so that the mounting bracket is not shaken with respect to the chassis. Also, the mounting bracket is shaped like an L-character in plan view, and raised at the corner portion of the chassis, so that the strength of the mounting bracket is increased by the shape of L-character in plan view, thereby serving to support the heavy flyback transformer securely and steadily.

Also, this invention provides a flyback transformer mounting structure for a video apparatus, comprising: a main wiring board; a power circuit formed on the main wiring board; a flyback transformer mounted on the main wiring board, the flyback transformer having a mounting portion provided on an upper end thereof and an adjusting screw; a chassis to which the main wiring board is attached; and a mounting bracket shaped like an L-character in plan view, molded of synthetic resin integrally with the chassis and raised at a corner portion of the chassis, the mounting bracket having an opening and a pair of longitudinal ribs interposing the opening therebetween, wherein the mounting portion of the flyback transformer is fixed by a screw to an upper end portion of the mounting bracket, a middle portion of the mounting bracket in a height direction is fixed by a screw to a cabinet of the video apparatus, and the adjusting screw of the flyback transformer faces the opening of the mounting bracket.

DETAILED DESCRIPTION OF THE PREFFERED EMBODIMENTS

Figure 1:
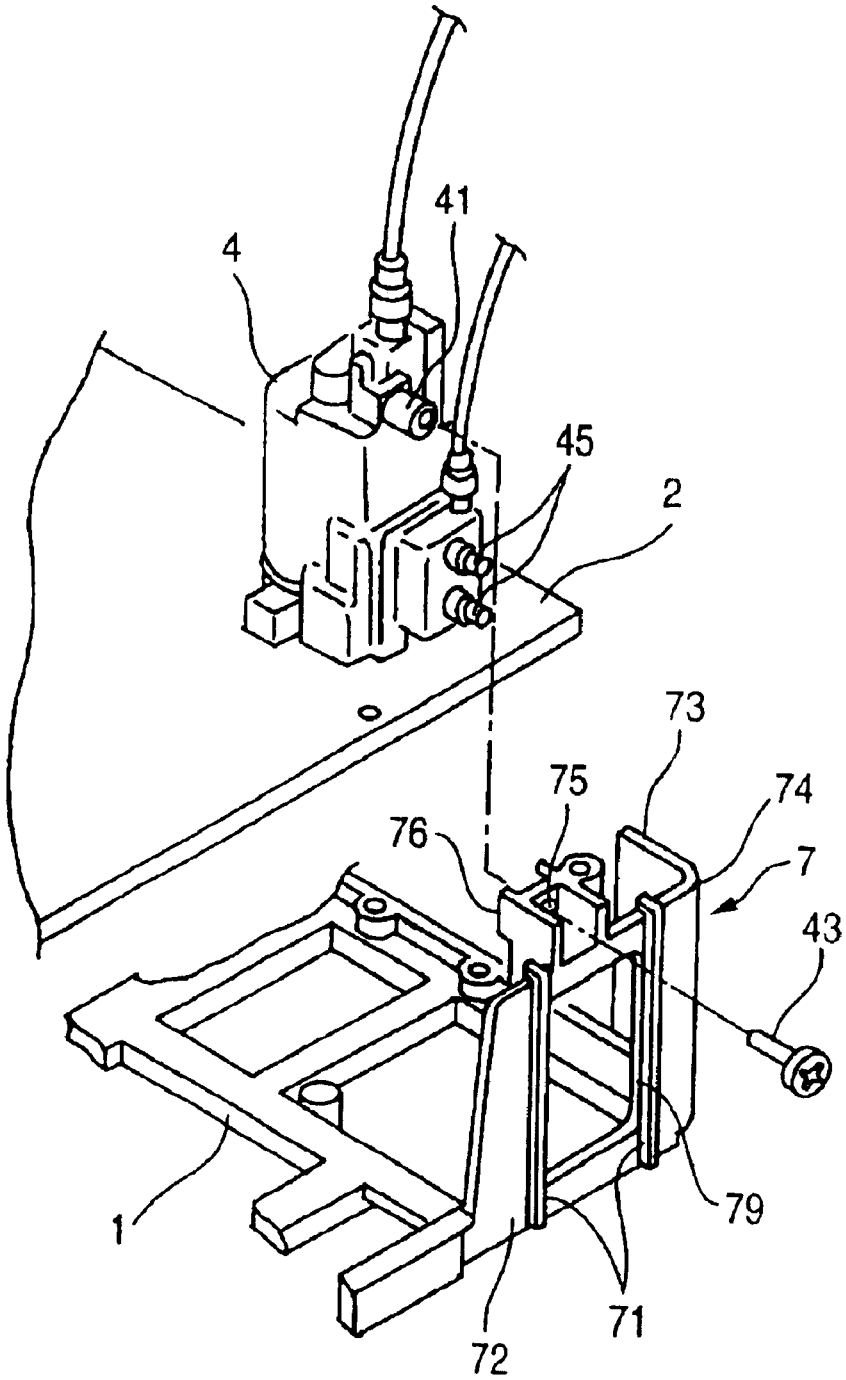
FIG. 1 is an exploded perspective view showing a flyback transformer mounting structure according to an embodiment of the present invention.
Figure 2:
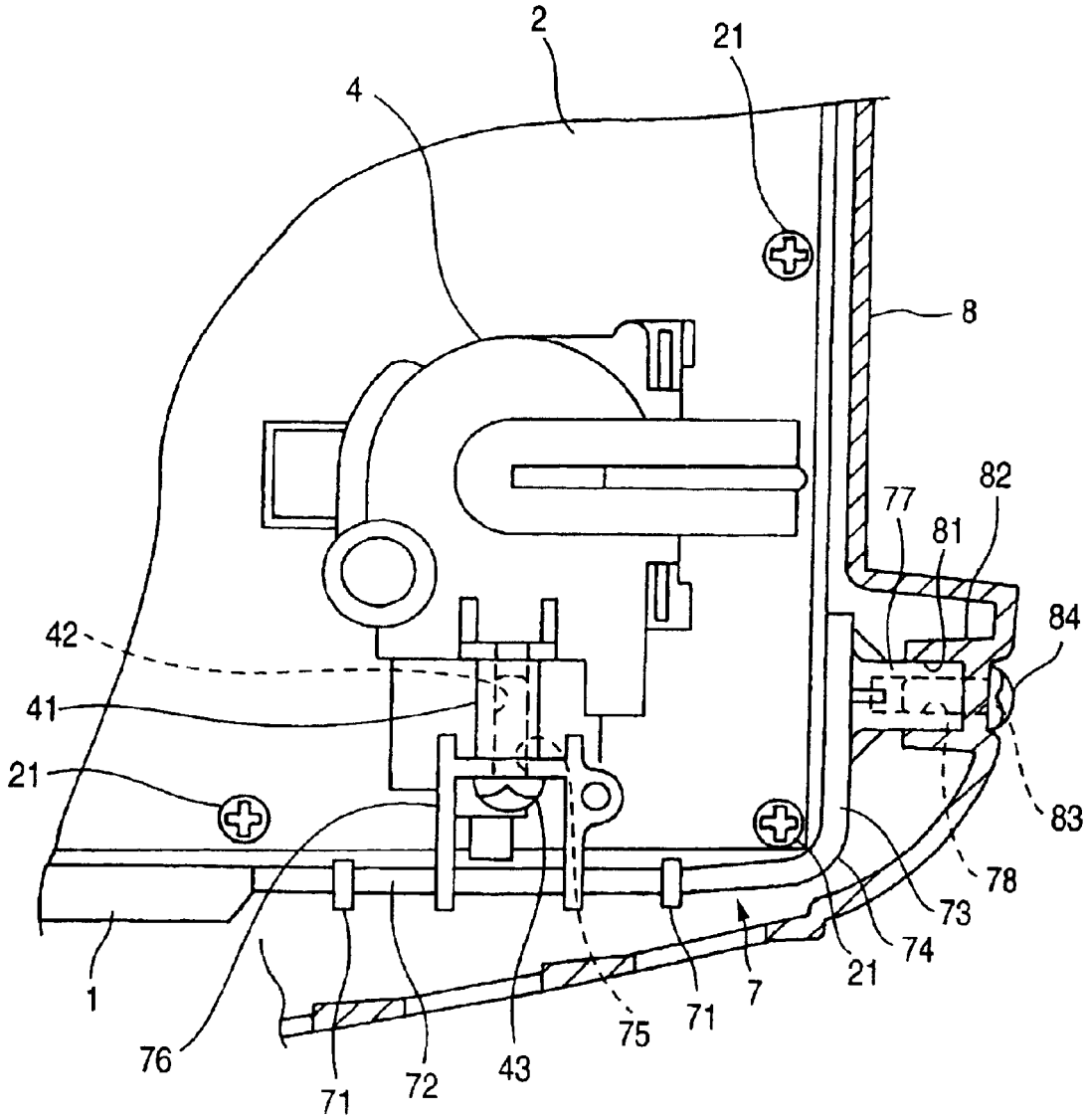
FIG. 2 is a plan view, partially in cross section, of the mounting structure.
Figure 3:
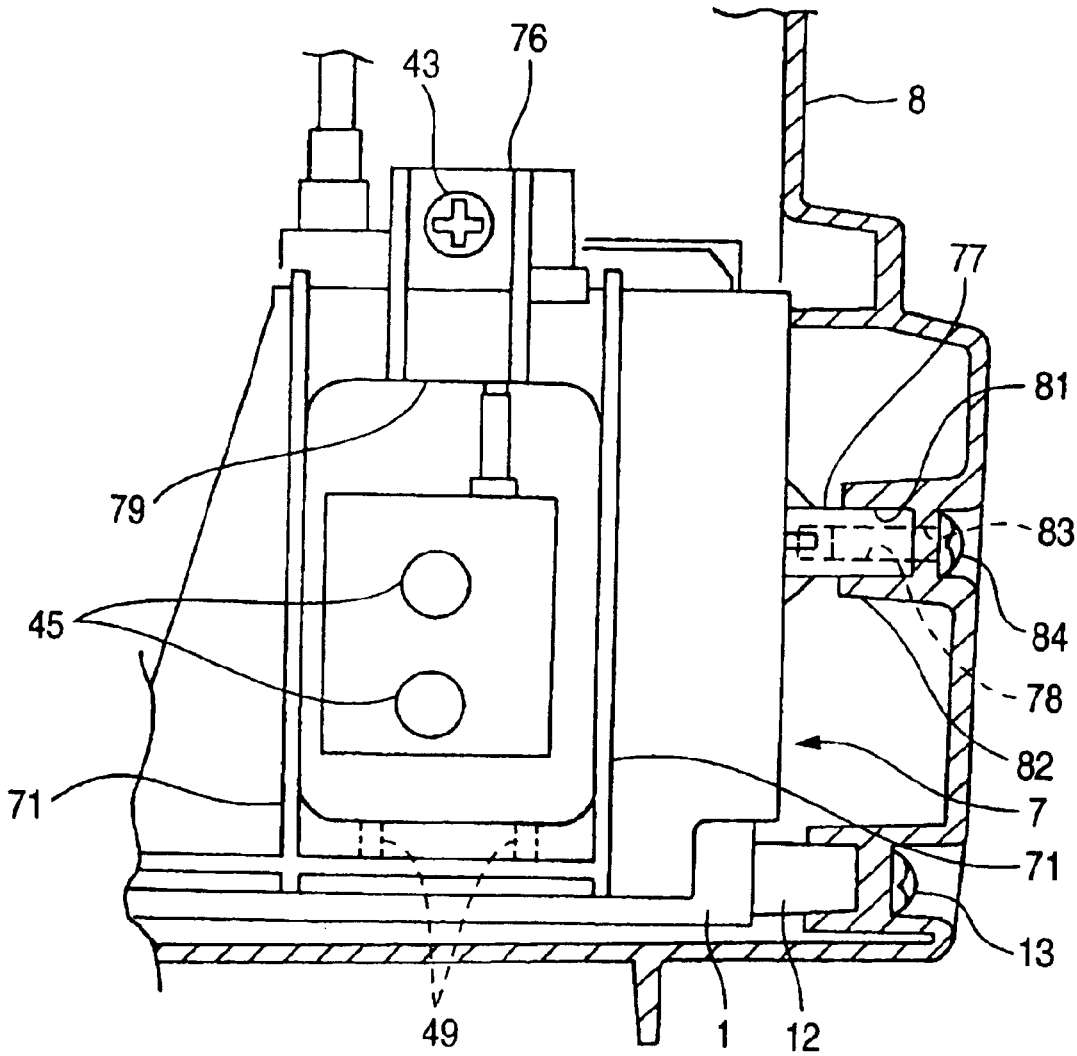
FIG. 3 is a side view, partially in cross section, of the mounting structure.

FIG. 1 is an exploded perspective view showing the essence of a flyback transformer mounting structure in a television receiver according to an embodiment of the present invention. FIG. 2 is a plan view, partially in cross section, of the mounting structure. FIG. 3 is a side view, partially in cross section, of the mounting structure.

Figure 4:
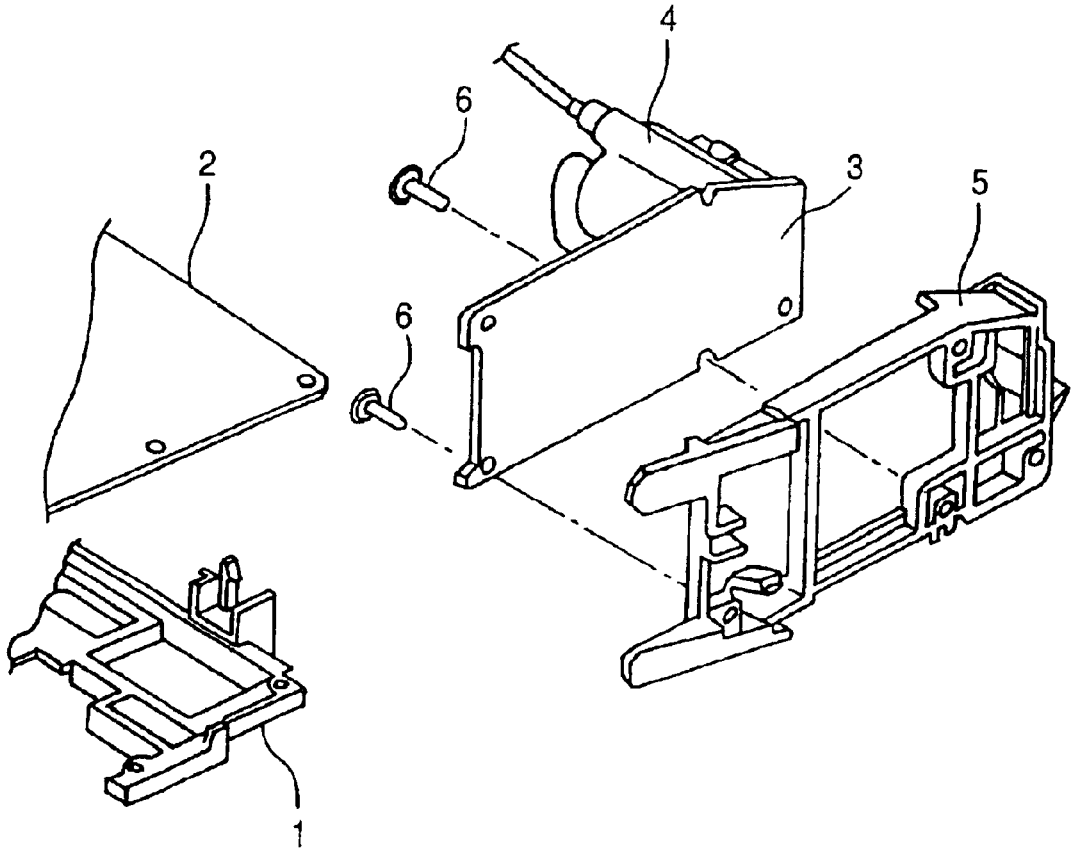
FIG. 4 is an exploded perspective view showing a conventional flyback transformer mounting structure.

In FIG. 1, 1 denotes a chassis, and 2 denotes a main wiring board. The main wiring board 2 is attached to the chassis 1 using an attaching screws, as shown in FIG. 2. The main wiring board 2 is formed with a power circuit, which is identical to that of a power circuit wiring board 3 shown in FIG. 4. A flyback transformer is mounted on an area of the main wiring board 2 in which the power circuit is formed. In the flyback transformer 4, a plurality of (e.g., three) engaging pawls 49 projecting from the bottom face thereof are formed and they are inserted and engaged into respective engagement holes formed in the main wiring board 2. A contact pin projecting from the bottom face of the flyback transformer 4 is inserted into a pin hole of the main wiring board 2, and soldered to a solder land on a back side of the main wiring board 2. In this manner, the flyback transformer 4 is connected via the engaging pawls and the contact pin to the main wiring board 2, so that the flyback transformer 4 is fixed to the main wiring board 2 securely. Also, the power circuit is formed on the main wiring board 2, and the flyback transformer 4 is mounted on the main wiring board 2, whereby the power circuit wiring board 3, the holder 5, and the screw 6 shown in FIG. 4 are not required.

As shown in FIGS. 1 to 3, a mounting bracket 7 shaped like an L-character in plan view and molded of synthetic resin integrally with the chassis 1 is raised at a corner portion of the chassis 1. This mounting bracket 7 includes a wider portion 72 and a narrower portion 73 linked via a smoothly curved corner portion 74, whereby the narrower portion 73 reinforces the wider portion 72 to increase a flexural rigidity of the wider portion 72, and a longitudinal rib 71 provided integrally with the wider portion 72 increases the flexural rigidity of the wider portion 72. Also, a mounting frame 76 shaped like a rectangle having a screw insertion bore 75 is provided at an upper end portion of the wider portion 72. A boss 77 having a threaded hole and projecting sideways at the middle portion in a height direction of the narrower portion 73 is provided. A large opening 79 is formed in the wider portion 72. Due to the formation of the large opening 70, the wider portion 72 has a lower flexural rigidity, but is reinforced by the longitudinal rib 71 to retain the flexural rigidity.

The flyback transformer 4 mounted on the main wiring board 2 is provided with a boss (an example of mounting portion) 41 having a threaded hole 42 at its upper portion. An axial direction of the boss 41 is orthogonal to an axial direction of the boss 77. A top end face of the boss 41 is placed on a screw insertion bore portion of the mounting frame 76 in the mounting bracket 7, and an attaching screw 43 inserted into the screw insertion bore 75 is screwed into the threaded hole 42 of the boss 41 and fastened, as shown in FIG. 2. In this manner, the flyback transformer 4 has its top portion connected to the mounting frame 76 at an upper end portion of the mounting bracket 7 raised from the chassis 1 by the attaching screw 43, and a lower end portion connected via the engaging pawls and the contact pin to the main wiring board 2 attached to the chassis 1, whereby the flyback transformer 4 is tightly fixed to the main wiring board 2 at the top portion and the lower end portion. Also, an adjusting screw 45 provided on the flyback transformer 4 faces an opening 79 of the mounting bracket 7, and thereby can be manipulated through the opening 79, as shown in FIG. 3.

The chassis 1 having the main wiring board 2 with the flyback transformer 4 mounted is fitted into a rear case 8 of a television cabinet, for example, as shown in FIGS. 2 and 3. When the chassis 1 is fitted into the rear case 8 and set at a predetermined position, the boss 77 provided in the narrower portion 73 of the mounting bracket 7 is fitted into a concavity 81 of a barrel portion 82 provided on the rear case 8. And the attaching screw 84 inserted into a screw insertion bore 83 provided in the barrel portion 82 is screwed into the threaded hole 78 of the boss 77 and fastened. Also, the boss 12 provided in the chassis 1 has the same structure, and is fixed via the attaching screw 13 to the rear case 8.

The use of the mounting structure of this embodiment exhibits the described effects, or more particularly, the effect of dispensing with the power circuit wiring board 3, the holder 5 and the screw 6 shown in FIG. 4, and the effect in which the mounting bracket 7 itself has a greater flexural rigidity owing to a reinforcing action of the longitudinal rib 71 and the narrower portion 73. Also, the mounting structure exhibits the following excellent impact resistance. That is, the boss 41 as the mounting portion of the flyback transformer 4 is fixed by the screw to the mounting frame 76 at the upper portion of the mounting bracket 7 linked integrally with the chassis 1, and the mounting bracket 7 is fixed by screws to the rear case 8 of the cabinet, whereby the chassis 1 and the mounting bracket 7 are embraced unmovably by the rear case 8. Also, the heavy flyback transformer 4 is held by the chassis 1 and the mounting bracket 7 linked integrally with the chassis 1, whereby even if the chassis 1 with the mounting bracket 7 and the rear case 8 are displaced due to an impact when dropped, the impact is not exerted onto the mounting portion (including a connected portion by solder) of the flyback transformer to the chassis 1 and the rear case 8, exhibiting the excellent impact resistance.

As described above, with this invention, the flyback transformer mounting structure for the vide apparatus can be provided. The flyback transformer can be mounted on the main wiring board, whereby the conventional power circuit wiring board and the holder are unnecessary to reduce the price. Nevertheless, the flyback transformer mounted on the main wiring board is fixed by screws to the mounting bracket integrated with the chassis attached to the main wiring board, so that the heavy flyback transformer can be securely supported against an impact when dropped. This effect is exhibited more conspicuously if the mounting bracket is held and fixed by screws to the cabinet such as the rear case. Therefore, the performance of the flyback transformer is stabilized, and the video apparatus having a long lifetime can be provided for the user.

What is claimed is:

1. A flyback transformer mounting structure for a video apparatus, comprising:

a main wiring board;

a power circuit formed on the main wiring board;

a flyback transformer mounted on the main wiring board, the flyback transformer having a mounting portion provided on an upper end thereof and an adjusting screw;

a chassis to which the main wiring board is attached; and a mounting bracket shaped like an L-character in plans view, molded of synthetic resin linked integrally with the chassis and raised at a corner portion of the chassis, the mounting bracket having an opening and a pair of longitudinal ribs, wherein the opening is disposed between the pair of longitudinal ribs, wherein the mounting portion of the flyback transformer is fixed by a screw to an upper end portion of the mounting bracket, a middle portion of the mounting bracket in a height direction is fixed by a screw to a cabinet of the video apparatus, and the adjusting screw of the flyback transformer faces the opening of the mounting bracket.

2. A flyback transformer mounting structure for a video apparatus, comprising:

a main wiring board;

a power circuit formed on the main wiring board;

a flyback transformer mounted on the main wiring board, the flyback transformer having a mounting portion;

a chassis to which the main wiring board is attached; and a mounting bracket linked integrally with the chassis, wherein the mounting portion of the flyback transformer is fixed by a screw to the mounting bracket.

3. The flyback transformer mounting structure for a video apparatus according to claim 2, wherein the mounting bracket is fixed by a screw to the cabinet.

4. The flyback transformer mounting structure for a video apparatus according to claim 2, wherein the chassis and the mounting bracket are integrally molded of synthetic resin, and the mounting bracket is shaped like an L-character in plan view, and raised at a corner portion of the chassis.

5. The flyback transformer mounting structure for a video apparatus according to claim 3, wherein the chassis and the mounting bracket are integrally molded of synthetic resin, and the mounting bracket is shaped like an L-character in plan view, and raised at a corner portion of the chassis.

* * * * *